US007530875B2

(12) United States Patent
Li et al.

(10) Patent No.: US 7,530,875 B2
(45) Date of Patent: May 12, 2009

(54) IN SITU CLEANING PROCESS FOR FIELD EFFECT DEVICE SPACERS

(75) Inventors: Hao Li, Chandler, AZ (US); James E. Jaskie, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 660 days.

(21) Appl. No.: 11/288,824

(22) Filed: Nov. 28, 2005

(65) Prior Publication Data

US 2007/0123136 A1 May 31, 2007

(51) Int. Cl.
*H01J 9/38* (2006.01)
*H01J 1/62* (2006.01)

(52) U.S. Cl. ..... 445/59; 313/495

(58) Field of Classification Search ..... 445/59; 313/495–497

See application file for complete search history.

(56) References Cited

U.S. PATENT DOCUMENTS 5,726,529 A 3/1998 Dean et al.
5,730,634 A * 3/1998 Seko ..... 445/3
6,031,336 A 2/2000 Rumbaugh et al.
6,380,914 B1 * 4/2002 Xie ..... 345/75.2
6,398,607 B1 6/2002 Pan et al.
6,624,592 B1 9/2003 Dunphy et al.
6,861,798 B1 3/2005 Pan et al.
2001/0009060 A1 7/2001 Browning et al.
2002/0039870 A1 4/2002 Kaneko et al.
2003/0148696 A1 8/2003 Kaneko et al.

OTHER PUBLICATIONS

International Search report PCT/US06/60606 dated Apr. 24, 2008.

* cited by examiner

*Primary Examiner*—Nimeshkumar D. Patel
*Assistant Examiner*—Anne M Hines

(57) ABSTRACT

A method is provided for in situ cleaning of spacers (42) separating an anode (14) and cathode (12) of a flat panel display (10) in a vacuum by impacting electrons upon the spacers (42).

20 Claims, 2 Drawing Sheets

IN SITU CLEANING PROCESS FOR FIELD EFFECT DEVICE SPACERS

FIELD OF THE INVENTION

The present invention generally relates to flat panel displays and more particularly to a method for in situ cleaning of spacers separating an anode and cathode of a flat panel display.

BACKGROUND OF THE INVENTION

Several types of spacers for flat panel displays, such as field emission displays, are known in the art. A field emission display includes an envelope structure having an evacuated interspace region between two display plates. Electrons travel across the interspace from a cathode plate (also known as a cathode or a back plate), upon which electron emitting structures, such as Spindt tip or carbon nanotubes, are fabricated, on an anode plate (also known as an anode or face plate), which includes deposits of light emitting materials, or "phosphors". Typically, the pressure within the evacuated interspace region between the cathode and anode is on the order of $10^{-6}$ Torr.

The cathode and anode plates are thin in order to provide low display weight. If the display area is small, such as in a 1 inch diagonal display, and a typical sheet of glass having a thickness of 0.04 inch is utilized for the plates, the display will not collapse or bow significantly. However, if a larger display area is desired, the thin plates are not sufficient to withstand the pressure differential in order to prevent collapse of bowing upon evacuation of the interspace region. For example, a screen having a 30 inch diagonal will have several tons of atmospheric pressure exerted upon it. As a result of this tremendous pressure, spacers play an essential role in large area, light weight displays. Spacers are structures placed between the anode and cathode plates for keeping them a constant distance apart. The spacers, in conjunction with the thin, light weight plates, counteract the atmospheric pressure, allowing the display area to be increased with little or no increase in plate thickness.

Several schemes have been proposed for providing spacers. Some of these schemes include the affixing of spacer (structural members such as glass rods) to the inner surface of one of the display plates. In one such prior art scheme, glass rods are affixed to one of the display plates by applying devitrifying solder glass frit to one end of the rod or post and bonding the frit to the inner surface of one of the display plates. Another known method uses thermocompression bonding to smash one layer of metal into another layer of metal. The bond that is created is strong enough to permit handling and sealing of the device components.

Regardless of the manufacturing process used, the process is inherently vacuum incompatible. Dimensioning, cleaning, and placing of spacers are accomplished in air (out of vacuum). As spacers sit in ambient air, they absorb moisture and hydrocarbons from the atmosphere. Known preventative methods include the use of nitrogen hood or high temperature bake out; however, since many spacers are usually required (as many as 1000 spacers for a 42 inch display, for example), the possibility of having a few contaminated spacers is high. If a spacer is contaminated with water or hydrocarbons and the anode and cathode plates are sealed, the spacers will be visible during normal operation of the display, even with previously known discharging methods.

Accordingly, it is desirable to provide a method for in situ cleaning of spacers separating an anode and cathode of a flat panel display. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A method is provided for in situ cleaning of spacers separating an anode and cathode of a flat panel display. The method for in situ cleaning of field emission displays having a plurality of spacers separating an anode plate and a cathode plate in a vacuum, and a plurality of electron emitters positioned on the cathode plate, comprises placing spacers between the anode plate and the cathode plate, positioning the field emission display in a vacuum, and cleaning the spacers by localized heating.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has been discovered that spacers can be cleaned as part of the production process after sealing in a vacuum by using high energy (>5 keV) electrons, and the electrons can be generated by the same electron emitters used for display in the field emitter device. The bombardment of electrons (beam) onto spacers leads to two effects: heating and scrubbing. The e-beam current on the spacer surface causes heat, and since it is extremely localized, the surface temperature on the spacer could be much higher than could be achieved with regular bake out. Therefore, it serves as a very effective local bake out, which drives out contaminants on the surface. Additionally, electrons also carry kinetic energy, which can dislodge weakly bonded surface molecules, which also contributes to the cleaning process.

In order to get bombarded by electrons, the spacers need to be positively charged to attract electrons, especially when there is no primary beam hitting the spacer. However, positive charging leads to a rapid field pull down, which in turn leads to breakdowns. Therefore, it is essential that proper discharging is employed together with the cleaning process. On the other hand, the more positive the spacer is, the more electrons get attracted and the more effective is the cleaning process. A careful balance needs to be established. Alternatively, a plasma may be created around the spacers by introducing an inert gas and establishing a local RF field.

Figure 1:
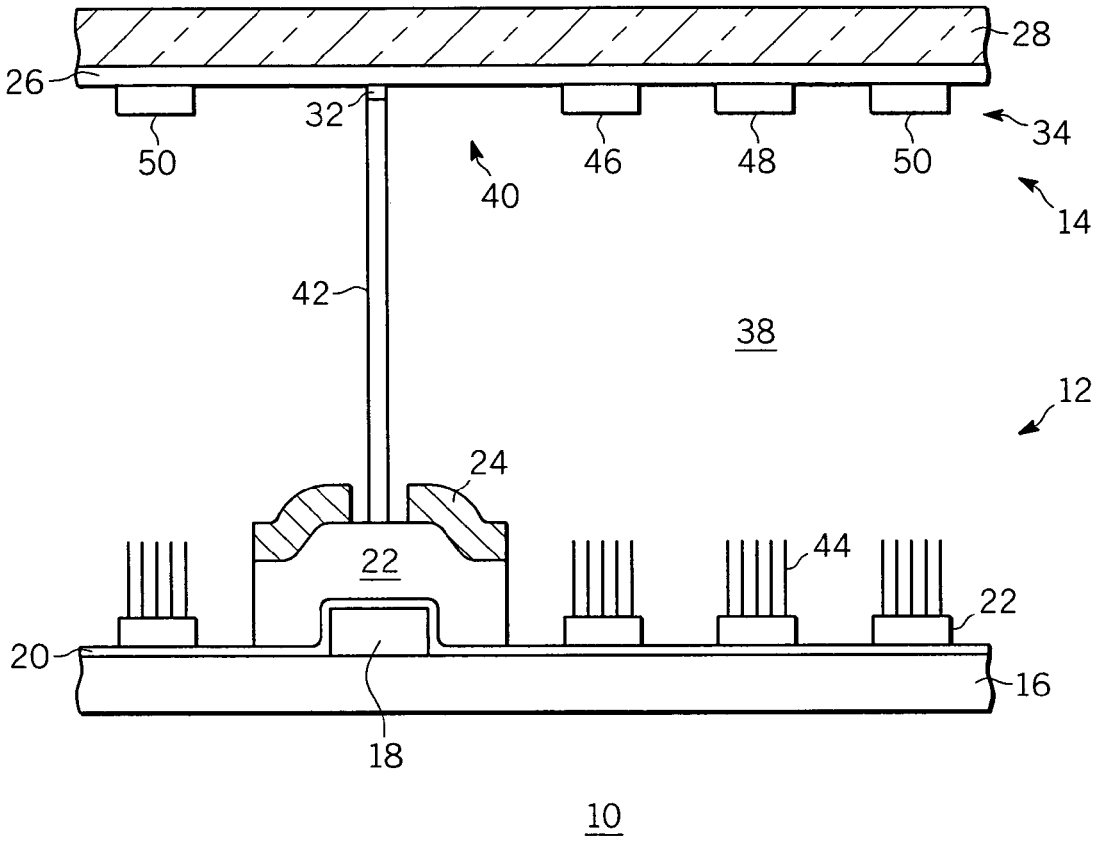
FIG. 1 is a partial cross section of a flat panel display.

Referring to FIG. 1, a previously known process for forming a cathode 12 and anode 14 of a field emission display device 10, which may be used with the present invention, includes depositing a cathode metal 18 on a substrate 16. The substrate 16 comprises silicon; however, alternate materials, for example glass, ceramic, metal, a semiconductor material, an organic material, or a combination thereof are anticipated by this disclosure. Substrate 16 can include control electronics or other circuitry, which are not shown in this embodiment for simplicity. The cathode metal 18 may comprise any conductive layer, for example, a chrome/copper/chrome layer. An optional ballast resistor layer 20 of a semiconductor material is deposited over the cathode metal 18 and the substrate 16. A dielectric layer 22 is deposited over the ballast resistor 20 above the cathode metal 18 to provide spacing for the gate electrode 24. The gate electrode 24 comprises a metal, preferably molybdenum. The above layers and materials are formed by standard lithographic techniques known in the industry.

A catalyst is formed on the ballast resistor 20, or in contact with the cathode 18 if the ballast resistor is not used. The catalyst 22 preferably comprises nickel, but could comprise any one of a number of other materials including cobalt, iron, and a transition metal or oxides and alloys thereof. The catalyst 22 may be formed by any process known in the industry, e.g., co-evaporation, co-sputtering, co-precipitation, wet chemical impregnation, adsorption, ion exchange in aqueous medium or solid state. One or more ancillary layers (not shown) for altering physical properties of the catalyst 22 optionally may be formed on the ballast resistor layer 20 and gate electrode 24 prior to forming the catalyst 22.

The anode 14 comprises a transparent plate 28, which is typically made of glass. A plurality of pixels 34 arranged typically in rows and columns across the anode 14 include deposits of a light emitting material, such as a cathodoluminescent material, or phosphor. A plurality of regions 40 exist between the rows and/or columns for making physical contact with spacers 42 so that a predetermined spacing can be maintained between the anode 14 and the cathode 12, without interfering with the light emitting function of the display 10 and thereby defining an evacuation area 38. The spacers 42 comprise a rigid material that is able to withstand intense pressure exerted by the anode 14 and cathode 12.

A black surround layer (black matrix) 26, for example ruthenium oxide, is formed on a transparent plate 28 of anode plate 14. The black surround layer 26 may comprise a thickness in the range of 1-20 μm, and more preferably is 5 μm. A ductile metal layer 32, preferably formed of silver, is applied on the black matrix 26 and adheres thereto. In the preferred embodiment, these layers are deposited with thick film techniques such as screen printing, electrophoretic deposition, or electroplating rather than thin film vacuum deposition techniques. The layer 28 may comprise a thickness in the range of 0.1-5 μm, and more preferably is 3 μm. These two layers may be formed across the transparent plate 28 and then screen printed to form the desired locations. For anodes built with the Fodel (photodefinable screen print paste) technology, the silver fodel and the black matrix can be deposited in sequential steps and then exposed with the same photomask. Light emitting material 18 is placed as pixels 34 by screen printing.

The phosphor-coated anode 14 described above presents the light emitting material to the direct impact of electrons. High voltage display designs benefit from providing a thin aluminum layer (not shown) over the light emitting material.

Electron emitting structures (not shown), such as Spindt tips (not shown) or carbon nanotubes 44, are positioned on the catalyst 22 for directing electrons at and illuminating the light emitting material 34 positioned on the anode 14 as is well known in the industry. Each pixel of the plurality of pixels 34 is divided into three subpixels 46, 48, 50. Each subpixel 46, 48, 50 is formed by a phosphor corresponding to a different one of the three primary colors, for example, red, green, and blue. Correspondingly, the electron emission sites on the cathode 12 are grouped into pixels and subpixels, where each emitter subpixel is aligned with a red, green, or blue subpixel 46, 48, 50 on the anode 14. By individually activating each subpixel 46, 48, 50, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

The spacers 42 are placed on the cathode 12 and anode 14 by one of a number of standard metal to metal bonding techniques, such as thermocompression bonding, thermosonics bonding, ultrasonic bonding and the like. In this particular embodiment, a thermocompression method is used to contact the silver layer 28. Mechanical deformation aids the bonding. The bonding is performed at elevated temperatures from 50-500 degrees, preferably at 250 degrees Celsius. A bonding force between 100 to 10,000 grams is then applied to the spacer.

Figure 2:
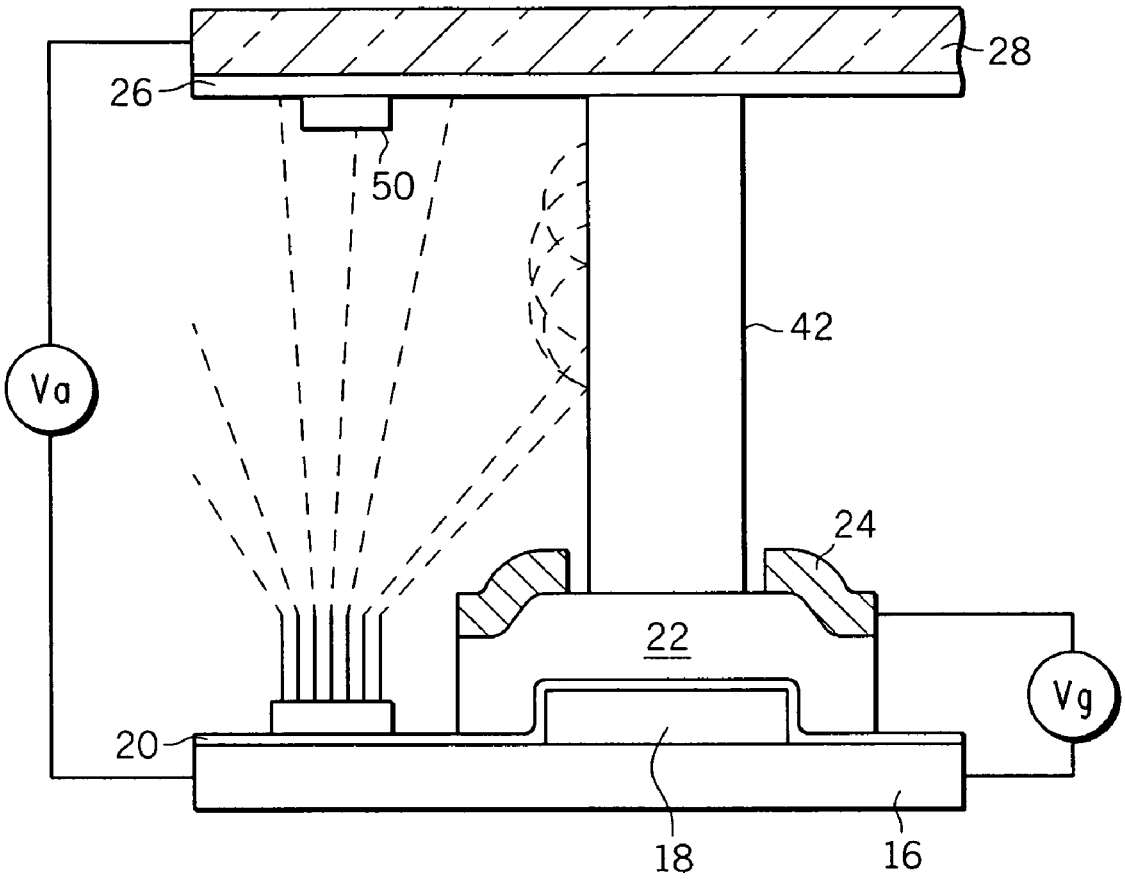
FIG. 2 is a partial cross section of FIG. 1 employing the process of the exemplary embodiment.

After the spacers 42 are positioned in their desired location and the flat panel display 10 is placed in a vacuum, a high voltage of 5,000 to 15,000 volts, for example, is applied between the anode and the cathode (this voltage may be higher than applied during normal operation of the flat panel display). This positive voltage pulls electrons from the electron emitters 44 toward the anode 14; however, some electrons are diverted to the spacer 42 (FIG. 2). This could result from the intrinsic divergence of emitted electrons, backscattered electrons from the anode, and/or a positive charge on the spacer attracting electrons. These diverted electrons possess a high energy due to the high voltage on the anode. As the electrons get closer to the anode 14, they gain in energy before striking the spacer 42. The bombardment of electrons helps remove surface anomalies, such as local roughness, edges, tips, as well as contamination, from the spacer surface. This bombardment of electrons (beam) onto spacers leads to two effects: heating and scrubbing. The e-beam current on the spacer surface causes heat, and since it is extremely localized, the surface temperature on the spacer could be much higher than could be achieved with regular bake out. For example, 1000° K in temperature only corresponds to ~0.075 eV in electron energy. Therefore, it serves as a very effective local bake out, which drives out contaminants, e.g., water, or hydrocarbons, on the surface. Additionally, electrons also carry momentum, which can dislodge weakly bonded surface molecules, effectively forming an electron assisted desorbtion process, which also contributes to the cleaning process. Alternatively, a plasma may be created around the spacers 42 by introducing an inert gas and establishing a local RF field.

To effectively utilize the emitted electrons for the cleaning process, the spacers 42 need to be positively charged to attract them. In general, spacers 42 will be positively charged under normal display conditions due to the secondary electron emission of spacers 42. However, accumulated positive charge leads to field 'pull down', the downward curvature of the anode field at the spacers 42, which in turn leads to breakdowns on the spacer surface. A certain amount of discharge is needed to keep the spacer surface from breaking down. This is done by running the display in a discharge mode once every frame or several frames. To achieve the discharge mode of operation, the anode voltage Va is reduced to a lower voltage, which may be several hundred volts or as low as ground potential. When the anode voltage Va is lowered, the gate/row voltage Vg is turned high to extract electrons from the emitters 44. These electrons are attracted by the positive surface charging on the spacer surface and they neutralize the positively charged spacers by "adding" electrons to the spacer

42. Care has to be taken however, not to overcompensate by adding more electrons than necessary to neutralize the spacer surface. This results in a negatively charged spacer surface, making the cleaning process less effective. Thus a careful balance needs to be established so that the spacers 42 are kept positive, with just enough discharge (negative) current to keep the spacer surface from breaking down from the accumulated positive charging. The amount of time for each discharging period strongly depends on the spacer materials, and ranges from a few microseconds to about 0.5 milliseconds. This process should continue until spacers 42 no longer appear visible under normal display conditions.

This cleaning process can be performed after spacers 42 are packaged inside the display 10 and before normal use. It can also be performed after the display 10 has been under normal use for a certain period of time as a maintenance procedure to ensure the spacers 42 are free of contaminations. In addition, it can also be performed before the assembly of spacers 42 in a display 10. The spacers 42 can be placed in a device with similar conditions as those in a display 10. A high voltage can be applied between the cathode 12 and anode 14 edge of the spacer and electrons can be provided by an electron gun or any other electron sources to simulate conditions in a display. A cleaning process similar to that inside a display can then be performed by applying high voltage while supplying electrons to the spacer surface. Without the voltage and current limitations posed by a display, higher voltage and electron flux can be applied to the spacers 42 than what is possible in a display. Spacers 42 can be cleaned more effectively in this manner.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A method for in situ cleaning of a field emission display having a plurality of spacers separating an anode plate and a cathode plate in a vacuum, and a plurality of electron emitters positioned on the cathode plate, comprising:

placing the spacers between the anode plate and the cathode plate;

packaging the anode plate and the cathode plate, including the spacers and electron emitters therebetween, to create a vacuum therewithin; and cleaning the spacers by impacting electrons from the plurality of electron emitters upon the spacers after the field emission display has been packaged.

2. The method of claim 1 wherein the cleaning step comprises local heating.

3. The method of claim 2 wherein the impacting step further results in removing contaminants from the spacers.

4. The method of claim 2 wherein the removing step further comprises removing one of hydrocarbons or water, or a combination thereof.

5. The method of claim 2 wherein the impacting step further comprises dislodging weakly bonded surface molecules from the spacers.

6. The method of claim 1 further comprising maintaining a positive charge on the spacers.

7. The method of claim 1 further comprising applying a higher voltage on the anode than is used during normal operations.

8. The method of claim 1 further comprising forming a plasma around the spacers.

9. The method of claim 1 further comprising forming a plasma around the spacers by introducing an inert gas.

10. The method of claim 9 further comprising forming a plasma around the spacers by applying an radio frequency signal.

11. The method of claim 1 further comprising completing assembly of the field emission display subsequent to the cleaning step being accomplished.

12. The method of claim 1 further comprising assembling the field emission device prior to the cleaning step being accomplished.

13. The method of claim 12 further comprising emitting electrons from the field emission device over a period of time prior to the cleaning step being accomplished.

14. A method for cleaning spacers between an anode plate and a cathode plate of a field emission display, the field emission display packaged to define a vacuum containing the spacers, anode plate, and cathode plate, comprising:

impacting electrons upon the spacers from a plurality of electron emitters disposed on the cathode plate, thereby heating the immediate area on the spacers surrounding where the electrons impact.

15. The method of claim 14 wherein the impacting step further results in removing contaminants from the spacers.

16. The method of claim 15 wherein the removing step further comprises removing hydrocarbons.

17. The method of claim 14 wherein the impacting step further comprises dislodging weakly bonded surface molecules from the spacers.

18. The method of claim 14 further comprising completing assembly of the field emission display subsequent to the positioning and impacting steps being accomplished.

19. The method of claim 14 further comprising assembling the field emission device prior to the positioning and impacting steps being accomplished.

20. The method of claim 19 further comprising emitting electrons from the field emission device over a period of time prior to the positioning and impacting steps being accomplished.

* * * * *